United States Patent [19]

Penque

[11] 4,052,009

[45] Oct. 4, 1977

[54] FIBERING SYSTEM AND APPARATUS

[75] Inventor: Ronald A. Penque, Glen Ridge, N.J.

[73] Assignee: Biocel Corporation, New York, N.Y.

[21] Appl. No.: 595,855

[22] Filed: July 14, 1975

[51] Int. Cl.[2] ..... B02C 19/18

[52] U.S. Cl. ..... 241/1; 241/46 R; 241/76; 241/79.2

[58] Field of Search ..... 241/1, 21, 24, 28, 29, 241/39, 43, 45, 46 R, 46.11, 46.17, 69, 72, 76, 79.2, 82

[56] References Cited

U.S. PATENT DOCUMENTS

| | | | |
|---|---|---|---|
| 2,340,511 | 2/1944 | Cowles | 241/21 |
| 2,578,274 | 12/1951 | Weigham et al. | 241/43 X |
| 2,641,971 | 6/1953 | Ellis | 241/39 X |
| 2,661,666 | 12/1953 | Knoll | 241/46 R |
| 2,954,173 | 9/1960 | Dunwody | 241/24 |

*Primary Examiner*—Granville Y. Custer, Jr.
*Attorney, Agent, or Firm*—Morton C. Jacobs

[57] ABSTRACT

A pulper for reclaiming cellulosic fiber from scrap paper includes a high-speed pressure-wave-generator impeller with individually hinged arms and a movable foraminous filter in the form of a wire screen that is flexibly mounted. A plurality of impellers and filters are used in a multistage pulper. The pulping energy is directed through the movable filter to isolate the energy source from contact with the fibers. In multistage fibering, filtering is performed between each stage and with successively finer filtering.

31 Claims, 12 Drawing Figures

FIBERING SYSTEM AND APPARATUS

BACKGROUND OF THE INVENTION

This invention relates to apparatus for reclaiming cellulosic fiber from scrap paper and the like.

Various types of apparatus have been used for reclaiming cellulosic fiber from scrap paper and the like (for which the term "pulper" is also used), among which is a pulper that produces pressure or shock waves in a liquid mixture to separate the cellulosic fibers. The latter type of pulper, also known as a "sonic pulper" because of the production of sonic or ultrasonic waves, is described in U.S. Pat. Nos. 3,323,733 and 3,420,454. Such a pulper is effective to defiber a paper sheet without mechanically shearing the cellulosic fibers, so that the fibers that are produced are longer and undamaged. ("Defiber" and "fiber" are terms used to describe the process of reducing cellulosic scrap materials, e.g., paper, into cellulosic fibers.) Moreover, the debris, such as plastic film, that customarily accompanies the scrap paper in municipal waste to be recycled is more readily segregated and removed from the paper fiber by a mechanical filter, for the plastic tends not to be sheared or otherwise broken down. Such pulpers have been found to be very effective in reclaiming cellulosic fibers from waste paper.

SUMMARY OF THE INVENTION

It is among the objects of this invention to provide a new and improved pulper.

Another object is to provide a new and improved pulper that is effective in reclaiming cellulosic fibers from scrap paper.

Another object is to provide a new and improved pulper that is efficient in operation and maintenance.

Another object is to provide a new and improved method or reclaiming cellulosic fibers from scrap paper.

In accordance with one embodiment of the invention, a new and improved pulper includes an impeller assembly rotatable within a container which receives a mixture of liquid and the paper scrap to be defibered. A diaphragm filter in the container restricts passage of the paper and any debris to an outlet until fibered to a size corresponding to the filter openings. The filter is constructed so as to move with the pressure waves that are generated by the impeller when rotating at high speed, whereby plastic film and other debris is vibrated off the filter and the latter is kept clear for passage of the fibers. The filter (a flexible wire mesh screen that is spring-mounted is used in one form of the invention) may be located either upstream or downstream from the impeller; where upstream, the filter isolates the impeller from the unfiltered debris. The impeller, in one form of the invention, takes the form of individual impeller blades that are hinged to a shaft-driven rotor, and moved by centrifugal force during rotation to an outstretched position for high-speed generation of pressure waves. In another embodiment of the invention, a plurality of impellers are mounted in a multistage container. Each impeller is in a different stage thereof, with the stage effectively defined by the impeller and a movable filter downstream. These filters may have different sizes of openings that are progressively smaller going downstream so that the fibering operation in one stage is completed before the material passes to the next.

DETAILED DESCRIPTION OF THE INVENTION

The foregoing and other objects of this invention, as well as various features thereof, may be more fully understood from the following description when read together with the accompanying drawing, in which.

In the drawing corresponding parts are referenced by similar numerals throughout.

Figure 1:
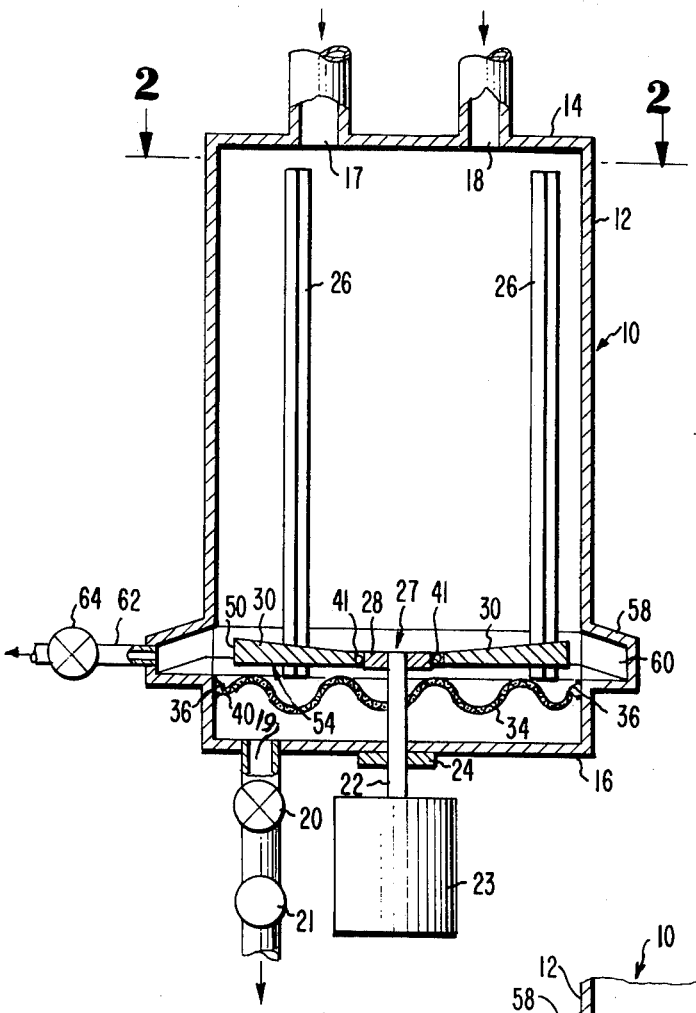
FIG. 1 is a sectional elevational view of a pulper embodying this invention as viewed along section line 1—1 of FIG. 2.
Figure 2:
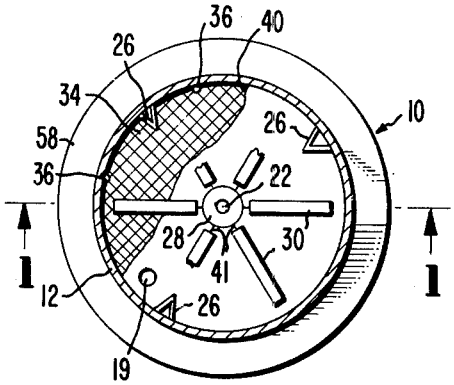
FIG. 2 is a sectional plan view taken along the line 2—2 of FIG. 1 with parts cut away.
Figure 3:
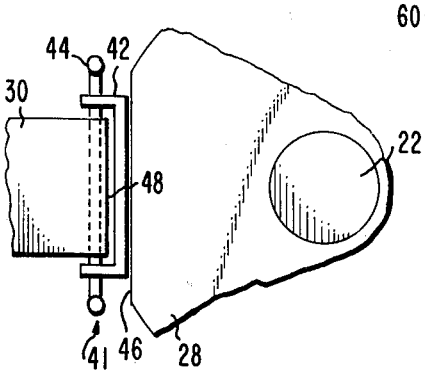
FIG. 3 is an enlarged fragmentary plan view of the impeller of FIG. 2.
Figure 4:
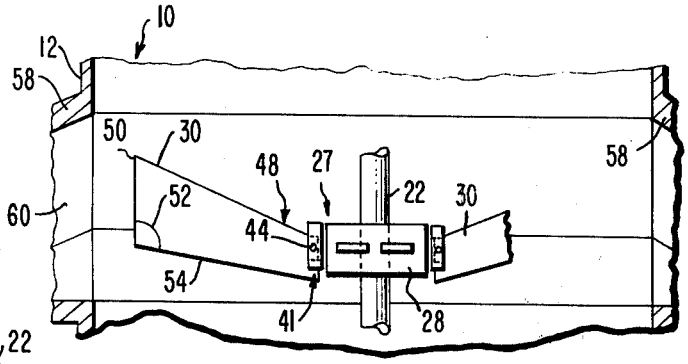
FIG. 4 is an enlarged fragmentary elevational view of an impeller of FIG. 1.

One embodiment of this invention (FIGS. 1 to 4) provides a cellulosic waste defibering apparatus comprising a container 10 fabricated of a metal such as steel, though other materials such as plastics may be used for certain applications. The container has a rigid generally cylindrical vertical wall 12, a substantially flat upper end closure 14 oriented in a plane transverse to the longitudinal axis of the cylindrical container 10, and a lower end closure 16 oriented substantially parallel to the upper end closure 14.

A plurality of top openings 17, 18 are provided in the container 10 which openings pass through the upper end closure 14 and permit a mixture of paper scrap and waste to enter said container 10 through one opening 17 and liquid (which may be unheated and chemically untreated water or which may contain suitable chemicals) to enter the other opening 18. Thereby a mixture of liquid and trash is produced within the enclosure of container 10, which trash is comprised primarily of cellulosic scrap materials, e.g., paper, cardboard, but also may contain, in some applications of this invention, noncellulosic waste materials insoluble in said liquid, e.g., cellophane, plastic wrap, metal foil, sand, staples.

The lower end closure 16 provides an outlet opening 19 through which defibered pulp may be drawn off from the container 10 at the conclusion of the defibering process. A flow control device 20, e.g., a slide valve, is provided at the outlet opening 19 and a pump 21 may be utilized to assist in removal and transport of pulped material.

A pressure-wave-generator for the container 10 includes an impeller assembly 27 driven through a rigid shaft 22. The latter is connected to rotational drive means 23 (e.g., an electrical motor) and enters the enclosure of the container 10 passing through the lower end 16. The interface between driver shaft 22 and end closure 16 is a sealed bearing assembly 24 whereby the integrity against liquid leakage of the lower end closure 16 is maintained. The rotational axis of the driver shaft 22 lies substantially parallel to the longitudinal axis of the container 10. The impeller assembly 27 which rotates within the container 10 is removably attached to the shaft 22, and includes blades 30 mounted on a central generally circular rotor 28 keyed rigidly and concentrically connected to the shaft 22. The general plane of said impeller assembly 27 is transverse to the longitudinal axis of the shaft 22.

A diaphragm filter 34, (e.g., a foraminous sheet such as a wire screen) is interposed between the impeller assembly 27 and the outlet opening 19 in the lower end closure 16. The filter 34 provides a highly flexible, generally planar surface, that lies transverse to the longitudinal axis of the container 10, and is circular in shape. The filter dimensions are set to provide a relatively small clearance with the container side wall 12, and is continuous save for a circular cutout to allow passage with a relatively small clearance, e.g., 0.010 to 0.125 inches of the impeller assembly shaft 22 therethrough.

Breakdown of the inputted cellulosic scrap products to produce a pulp comprised of cellulosic fibers is accomplished by high-intensity, pressure-wave energy dispersed in the mixture of liquid and scrap. Mechanical contact and shearing between the rotating impeller assembly 27 and the scrap materials is not a substantial factor in the fibering process. However, pressure waves which produce the defibering without mechanical contact of the impeller derive primarily and secondarily from the impeller actions. The defibering action is a general loosening of the bonds between the fibers forming the scrap without the fibers themselves being torn.

As an impeller blade 30 moves through the mixture, liquid at the forward face of the blade is compressed and at the same time a zone of reduced pressure is produced behind the blade. The compressed liquid molecules press on the surrounding molecules, which in turn press on farther situated molecules so that a wave of increased pressure emanates and spreads with the velocity of sound in the media from the forward face of the blade. Behind the blade, liquid molecules rush into the zone of reduced pressure, thus, a wave of reduced pressure emanates from the rear face of the blade.

Further, when the pressure behind the blade is sufficiently reduced, i.e., pressure-wave amplitude is great, bubbles (cavities) of gas and vapor form in the media which expand as the pressure decreases. When the pressure in the media surrounding the bubbles increases the bubbles compress and collapse. The inrush of liquid to fill the bubble creates a water hammer effect; waves of high-pressure intensity including shock waves travel through the media. (Shock waves, i.e., a pressure jump, occur when the pressure-wave generator's velocity in the direction of wave propagation exceeds the velocity of wave propagation in the medium).

The high rate of occurrence of these pressure waves of high intensity which travel through the medium cause repeated and reversed dislocations in the cellulosic materials resulting in separation of the fibers. The waves of pressure radiating from the impeller 30 which travel through the main body of the mixture cause vibration of the scrap materials. When the frequency of these vibrations is sufficiently high, cavitational voids may form near the vibrating scrap materials, the rapid collapse or oscillation of these voids again generating high-intensity pressure waves in the medi. Also, a plurality of direct and reflected pressure waves in the mixture may from place to place interfere to locally reinforce or cancel their energies. Again cavitational voids may form; and their rapid collapse or oscillation creates high-intensity pressure waves in the medium which act on the scrap to be fibered.

By means of individual hinge joints (FIGS. 1 to 4) a plurality of impeller blades 30 of extended length are independently and pivotally attached to the rotor 28. Each of these joints 41 comprises a separate generally U-shaped bracket 42 rigidly attached to flat peripheral surface 46 of the rotor 28, with legs of the bracket extending away from the axis of rotation and the base of the bracket transverse to the rotational axis of the shaft 22. The end 48 of an impeller blade is positioned between the outward pointing bracket legs, and an elongated pin 44, headed on both ends, passes through both legs of the bracket 42 and the end of the intermediately positioned impeller blade 30 to fasten the impeller blade 30 to the bracket. Centrifugal forces extend the blades 30 radially from the rotor 28 during periods of shaft rotation at operational speeds. When the shaft 22 is static or operating at low rotational rates, the blades 30 fall somewhat.

The impeller blades 30 may have a variety of sizes, shapes and other design features whereby rotation of the rotor 28 and attached impellers 30 causes displacement of portions of the mixture and produces turbulence and cavities in said mixture of liquid and waste materials. Thereby pressure waves including shock waves produced at the impeller surfaces and in cavitational zones of the main body of fluid mixture travel throughout the mixture shredding the cellulosic waste by impulse and reversing forces. Said waves reverberate from internal materials and container surfaces until the pressure and shock wave energy has been dissipated in the container contents; there is some temperature elevation.

In a preferred embodiment of this invention six equally-spaced impeller blades produce satisfactory performance but other numbers and spacing of blades 30 may also be used. Viewed in profile and in a position representative of orientation at operational speed (FIG. 4) the impeller blades 30 appear somewhat as an extended truncated triangle with the narrower cutoff end 48 hingedly pinned to the rotor 28 as heretofore described, and the opposite free-moving edge 50 lying generally parallel with the wall 12 of the container 10 and forming an obtuse angle 52 with the adjacent impeller edge 54 nearer the outlet end of the container 10.

The hinged joint between impeller blade and rotor allows each blade 30 during rotation to assume a self-balancing angular position which reduces bending stresses in the blade itself and in shaft 22 and reduces imbalances of the rotor assembly 27 due to minor differences in size or weight of the blades due to manufacture tolerances. Additionally, as blades are eroded by abrasion and cavitation in the liquid, the hinged connection allows self-adjustment in blade position to reduce imbalance stresses. Clearance between the rotating impellers 30 and the container side wall 12 is not critical. In an embodiment wherein said impellers rotate on an axis concentric with the wall 12 a clearance of approximately one inch produces satisfactory results.

Longitudinal location of the impeller assembly 27 within the container 10 is not critical, but a position remote from the inlet opening 18 utilized for input of waste products to be defibered is preferred in that mechanical interaction between the impellers 30 and unprocessed waste matter (which interaction tends to shear and shorten the cellulosic fibers) is minimized.

In the container 10 a plurality of baffles 26 attached to the side wall 12 reduce swirling and general circular motion of the liquid-solid mixture and minimize any attendant central vortex which may be induced by the impeller's rotative action. Reduction in liquid swirling increases the relative motion between impeller blades 30 and the liquid mixture and enhances the defibering action. In one form of the apparatus of this invention, baffles 26 being fastened to side wall 12 with its longitudinal axis substantially parallel with the longitudinal axis of the container 10, and the apex of each baffle angle extended toward the center of the container 10. Three baffles prove effective, but the number of baffles need not be so limited.

By repeated action of the aforesaid pressure waves on the waste and by dissipation of pressure-wave energy into the mixture, a defibering of the cellulosic materials is produced. Defibering results substantially from the effects of pressure-wave pulsations including shock waves when energy input is high, on the mixture rather than from mechanical shearing action between the mixture and the rotating impellers 30. Because the defibering is principally by pressure-wave action, long fibers in the inputted waste materials are generally not cut or broken in the defibering process, and the resultant defibered pulp mixture contains long and short pulp fibers generally representative of the original fiber content of the inputted waste products. Non-cellulosic materials in the waste materials (e.g., cellophane, foil, staples, sand) are generally not destructively affected by the pressure-wave energy and remain intact whereby they can be separated from the fibers and removed as debris.

Efficient defibering action results when cavitational activity is continuously produced in said mixture. Sufficiently high velocity of the impeller blades 30 through the liquid mixture induces the preferred cavitational condition; linear velocities in the order of 100 to 1,000 feet per second at the outer extremity 50 of the impeller blade 30 produce satisfactory results.

Figure 12:
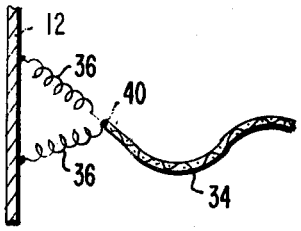
FIG. 12 is a side elevational fragmentary view illustrating the flexible mounting of the filter of FIG. 1.

The diaphragm filter 34 is flexibly attached to the side wall 12 by a plurality of spring supports 36 equispaced around the peripheral edge 40 of the filter 34. The spring supports 36 are attached (FIG. 12) above and below the filter 34, at one end to the filter and, at the other end, to the wall 12. Six separate pairs of spring supports 36 are used; various other numbers of supports may be used to adequately retain the filter 34 in position during operation.

Because of the lightweight and flexible quality of the porous filter material itself (e.g., a stainless-steel, woven-wire screen) and the flexible mode of attachment of the filter 34, the filter "floats" in the mixture, and the pressure and shock waves in the mixture produced by action of the impellers 30 induce vibrations and oscillations in the filter 34. The resultant motion of the filter surface 34 may result from small amplitude rapid vibratory movements of the filter combined with slower surface flexures of greater amplitude both induced directly by pressure waves in the mixture. Additional components of filter displacement may result from oscillations and translations of the filter 34 on the flexible attachments 36 which support the peripheral edge 40 of the filter. Finally, vibrations in the container wall 12 induced by internal sources, e.g., pressure waves in the mixture, and external sources, e.g., the drive motor 23 vibrations, may be transmitted to a limited extent through the flexible supports 36 of the filter 34 into the filter 34 itself. The oscillatory movement and vibration of the filter surface tends to keep the filter clear and to avoid blockage of the filter surface, which might otherwise be caused by accumulation of larger pieces of partially defibered cellulosic waste and of non-cellulosic materials that are unaffected by the defibering process. Thereby, longer periods of process and apparatus operation are enabled without necessity for shutdown to clean the filter.

The diaphragm filter material is selected for its lightweight and flexible quality and for its ability to allow passage therethrough of long and short fibered pulp produced by pressure-wave action on the waste mixture. At the same time, the filter rejects from passage larger fiber clumps and inert debris materials such as sand, metal, foil, plastic film and cellophane. In a particular embodiment of this invention a flexible woven stainless-steel wire cloth and designated as 40 mesh was used to isolate the debris from the cellulose fibers in the output. A range of mesh sizes may be used for different purposes and different types and sizes of fibers.

In addition to its inherent self-cleaning features the vibrating and oscillating filter 34 has the further advantage discussed more fully hereinafter in that it produces less attenuation of pressure waves (and more energy is transmitted therethrough) than through a rigid and static filter. Still further, the motion of the filter surface in response to the pressure waves in the waste mixture tends to ease passage therethrough of long fibers of pulp which because of their length and the need to pass end-first through small filter openings tend to tangle and pass with relative slowness through a static filter of similar passage dimensions.

An annular channel member 58 circumscribes, embraces and attaches to the wall 12 of the container 10 to form an annular debris channel 60 between upper and lower sections of wall 12. The general place of this chamber is substantially parallel to the plane of the rotor 28 and in proximate location thereto. The oscillating the vibrating diaphragm filter 34 is positioned between the outlet 19 in end closure 16 and the longitudinal location of chamber 60 along the container wall 12. Cutout sections in the wall 12, leaving connecting portions of the container 10, adjacent to said annular debris chamber 60 provide substantially unimpeded fluid communication means between the enclosure of container 10 and the lesser enclosure of annular chamber 60. Centrifugal forces in the fluid mixture in proximity of the impellers 30 induced by rotation of the impeller assembly 27 cause heavier materials in the mixture, i.e., those having a density exceeding that of the aqueous slurry in the container 10, to travel through the mixture and collect at the outer periphery of the container 10 and inside the annular chamber 60. Such heavier materials, usually non-cellulosic debris (e.g., sand, staples, metal foil), once entered into the relative isolation of the chamber 60 tend to remain trapped therein.

An outlet 62 from the annular chamber 60 and a flow control device 64, e.g., a slide valve, provide means to periodically discharge said waste materials from the debris chamber.

In progressing through the mixture to the outer walls the heavier waste materials impact with and impart momentum to lighter materials in the mixture. Thus, substantial amounts of material less dense than the aqueous mixture in the container 10 (e.g., cellophane, plastic film, which generally tend to remain suspended in the mixture unmoved by centrifugal forces) are thereby moved to the recesses of annular chamber 60 where they are withdrawn from the apparatus concurrently with the aforementioned heavier wastes.

Figure 5:
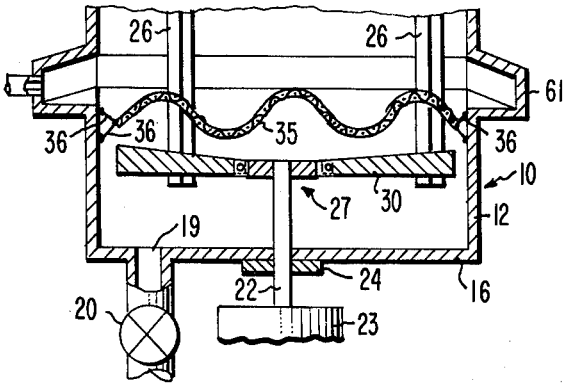
FIG. 5 is a fragmentary sectional elevational view similar to FIG. 1 and illustrating a modified form of the invention.

In an alternative embodiment of this invention (FIG. 5) the diaphragm filter 35 (physically identical to the above-described filter 34) and its associated supports 36 are located so that the impeller assembly 27 occupies an intermediate position between the filter 35 and the outlet opening 19. Thereby isolation is provided to the impeller assembly 27 from large particles and objects imputted as part of the trash mixture but defibered pulp as before is free to pass through the filter openings to the outlet 19. Fluid communication is maintained throughout the entire body of materials in the container 10 and the "floating" characteristics and non-rigid mounting of the filter 35 provide transmission with little attenuation of pressure waves originating from the motion of the impeller assembly 27. These high-intensity waves pass through the filter retaining sufficient energy to induce cavitation effects in the main body of scrap and liquid mixture.

As an adjunct of this alternative embodiment, an annular chamber 61 is positioned upstream of the filter 35 but adjacent thereto, i.e., filter 35 has a longitudinal position in container 10 between the chamber 61 and the impeller assembly 27. Thereby as a result of rotation of the waste mixture and motions of filter 35, solid waste and undefibered materials collect in chamber 61, and are prevented from obstructing the filter surface 35 and do not engage the impeller blades.

Efficient defibering of inputted cellulosic waste by means of pressure waves including shock waves transmitted throughout the liquid medium and without any mechanical contact with the rotating impeller blades is achieved notwithstanding that the filter 35 physically separates the inputted paper waste from the moving impeller. Only material already completely defibered is able to pass through the filter. Impeller and rotor surfaces are protected from damaging effects inherent in contact with solid materials in the mixture, and the operating life of the apparatus is improved thereby.

In another embodiment (FIG. 6) of this invention driven shaft 22' extends longitudinally through the entire length of container 10' supported in sealed bearings 24', 68 in opposite end closures 14', 16'; parts corresponding to those previously described are referenced by the same numerals with the addition of one or more primes (').

In a manner similar to impeller assembly 27 and filter 34 described above, a plurality of impeller assemblies 27' to 27'''' similar to impeller assembly 27 in dimension, construction, attachment and operation are located at longitudinal intervals along extended shaft 22'. A total of four stages having four impeller assemblies would be satisfactory but a greater or lesser number may be used and dimensional identity of rotor assemblies is not a requisite to satisfactory performance.

Because energy in the mixture varies in a generally inverse exponential ratio to the distance from the energy source, utilization of a plurality of impellers longitudinally arranged in container 10' provides means for a more uniform input and distribution of pressure-wave energy throughout the mixture and far faster and more efficient defiberization of imputted paper waste.

Associated with each impeller assembly of this embodiment is a vibrating and oscillating filter 34', 34'', 34''', 34'''' in the manner of filter 34 described above and an annular chamber 60', 60'', 60''', 60'''' for storage of inert scrap in the manner of chamber 60 heretofore described. Each of the filters is attached to container wall 12' at a position downstream of its associated impeller, i.e., the associated filter is closer to outlet 19' than its impeller assembly. Size of openings for passage of material through said filters differs progressively from filter to filter such that only completely defibered pulp and smaller particles, e.g., ink, filler, plasticizer, can pass through the final downstream filter 34' and all other material of larger size is prevented from passage therethrough. The next preceding filter stage 34'' is capable of passing somewhat larger sized materials than is the final filter 34', and in a similar way, filters 34''', 34'''' further upstream admit for passage of progressively larger sized materials. Each filter is flexible and flexibly mounted as heretofore described.

Mesh sizes 50, 100, 150, 200 may be utilized in a longitudinal succession of filters with mesh size 50 located nearest to the inlet openings 17', 18'. In an alternative embodiment an additional filter (not shown) may be interposed between the inlet openings 17', 18' and the impeller assembly 27'''' in an arrangement similar to FIG. 5 to prevent direct contact of inputted waste materials with the first stage impeller assembly 27''''.

Each of said associated annular chambers 60', 60'', 60''', 60'''' is attached to container wall 12' at a position between its impeller and associated filter such that inert material may be separated at each stage from the mixture by impeller-induced swirling and filter surface motion as previously described. Each annular chamber 60' to 60'''' has a valved outlet 62' to 62'''' and inert wastes collected in the debris chambers may be drawn off periodically as the composition of the inputted paper scrap requires.

As a result of self-cleaning movements of the filter surfaces and removal to annular chambers of inert materials at a plurality of longitudinal positions in container 10', the apparatus of this embodiment employing a plurality of stages comprising impellers, filters and annular debris chamber can operate continuously. In said continuous mode of operation liquid and waste material are inputted in batches or in uninterrupted flow, and defibered pulp is removed in batches or continuously at the outlet 19' for extended time periods without need to discontinue impeller assembly operation or to cease operation in order to clean filter surfaces. Economic advantage is achieved by continuous apparatus operation as compared to the batch or semi-continuous operation of prior devices requiring regular shutdown for inputting and removal of product materials and for cleanout of inert scrap.

The defibered pulp removed at the outlet 19' contains fiber having a cross-sectional area less than the size of openings in filter 34' of the last stage. Larger-sized fibers and waste materials, and partially defibered material remain substantially above the filter subject to continued reducing action of the rotating impellers or separation in the annular chamber 60′ as described above. Product containing larger fibers may be drawn from the mixture upstream of a filter, or of a plurality of filters, e.g., via an outlet duct 62′. Also product may be withdrawn simultaneously both upstream and downstream of a filter, or plurality of filters, in proportions determined by settings of the discharge valves, e.g., valves 20, 64′. The materials drawn via duct 62′ and valve 64′ would be separately filtered to separate debris from useful fibers. In this way, a fractionated product providing materials in a range of controlled sizes and amounts is achieved as desired by the operator.

Figure 7:
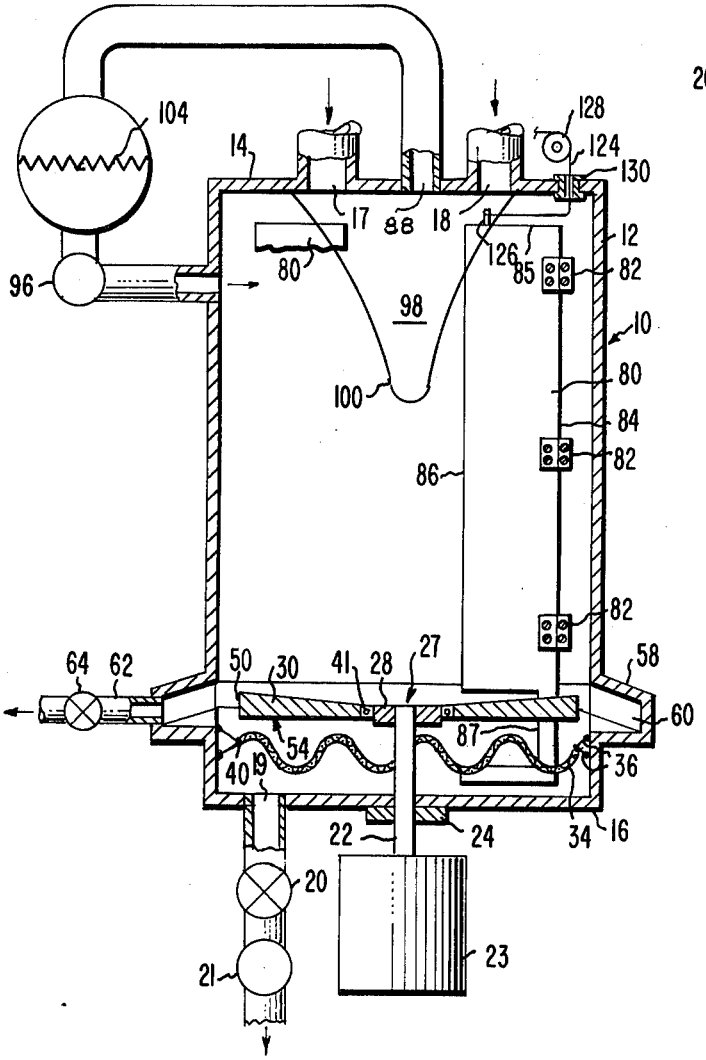
FIG. 7 is a sectional elevational view taken along the line 7—7 of FIG. 8 with parts omitted of another embodiment of this invention illustrating movable baffles.
Figure 8:
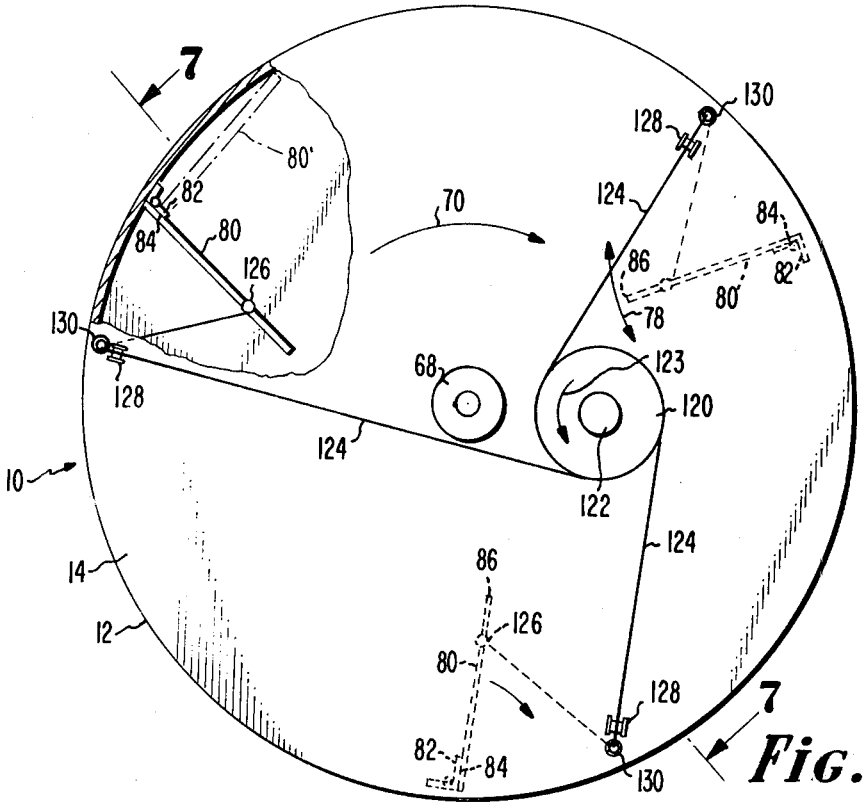
FIG. 8 is a top plan view partially cut away of a modified form of this invention illustrating a movable baffle construction used therein.

In another embodiment (FIGS. 7, 8) of this invention, the baffles 26 (FIG. 1) attached to side wall 12 are replaced by a plurality of generally rigid rectilinear baffle plates 80 attached by hinges 82 along one longitudinal edge 94 to side wall 12. The longitudinal axis of each plate parallels the longitudinal axis of the container 10. The unattached longitudinal edge 86 of each baffle plate can traverse an arc of as much as about 180° through the mixture as the baffle plate 80 is pivoted on its hinges 82 from one extreme position to the other. The baffle plates 80 are substantially flat but in an alternative configuration the plate may have a curvature such that when the baffle plate 80 is retracted against the side wall 12, it nests against that side wall. FIG. 8 shows the baffles extended into the waste mixture. A transverse rectilinear notch 87 extends from edge 86 into baffle plate 80 and thereby provides clearance between baffle plate 80 and impeller assembly 27 and filter 34.

Each baffle plate 80 is movable to its retracted position near the wall 12 by a separate mechanism comprised of a drum 120 driven by a reversing motor 122, a cable 124 which is attached at one end to a headed lug 126 extending from the upper edge 85 of the baffle plate 80 and at the other end to the drum 120, via a pulley 128 and members (not shown) to guide the cable 124 around turns in its path between baffle plate 80 and drum 120. The cable 124 slides generally perpendicularly upward through a flexible liquid-tight grommet 130, e.g., rubber, attached to the upper end closure 14, of the container 10. All drums 120, one associated with each baffle plate 80, are aligned coaxially (so that only one is seen in the plan view of FIG. 8) and driven in unison by the reversing motor 122.

When the drums 122 rotate in the direction of arrow 123 (FIG. 8), the cables 124 are taken up and wound upon their respective drums 120; the baffles 80 swing on the hinges 82 and move toward the container wall 12. When the motor 122 is reversed, the cables 124 unwind from their drums and the force of the swirling mixture in the container 10 in the direction of arrow 70 impacting on the baffles 80 returns the baffles 80 to their extended positions in the mixture (FIG. 8). The particular means to move the baffles 80 between the extended and retracted positions are not part of this invention, and various other methods to implement this function will be apparent to those versed in the art.

When the defibering apparatus is operating, the baffle plates 80 are generally extended into the waste mixture in a fixed position such as shown in FIG. 8, thereby substantially preventing a swirling rotation of the liquid mass. A greater production of high energy pressure waves in the mixture results because of the increased relative motion between impeller blades 30 and the waste mixture when the mixture does not swirl. Thus, the speed and efficiency of the defibering process is improved. Three equi-spaced individual baffles 80 are effective to reduce swirl but the number of baffle plates is not limited to this amount.

Intermittently, during operation of the apparatus the baffle plates 80 are retracted to a position against the container side wall 12 shown by the dot-dash line 80′. Action of the impeller assembly 27 induces rapid swirl (arrow 70) into the waste mixture whereby under the effect of centrifugal forces inert debris (e.g., metal foils, staples, sand) having higher density than the mixture moves rapidly toward the container wall 12 and a substantial proportion of such debris is isolated from the mixture and collected in the annular chamber 60, associated with the filter 34 and impeller 27 for later removal. The rapid swirl of the mixture also causes inert debris (e.g., cellophane, plastic wrap) of lower density than the mixture to migrate to the center of the rotating mass. When the container 10 is not completely filled a hollow conical vortex 98 (FIG. 7) forms at the approximate center and near the top of the rotating mixture and said lower density debris collects on and near the vortex wall 100. by inputting additional liquid into the container 10, the size of the hollow vortex 98 is diminished and a mixture containing the lightweight debris is discharged from a central outlet 88 provided in the top end closure 14. The discharged mixture flows through pump 96 and back into the container 10 after it has passed through a coarse screen 104 (e.g., 40 mesh) to remove the unwanted lighter debris which is inert to the defibering process.

Figure 9:
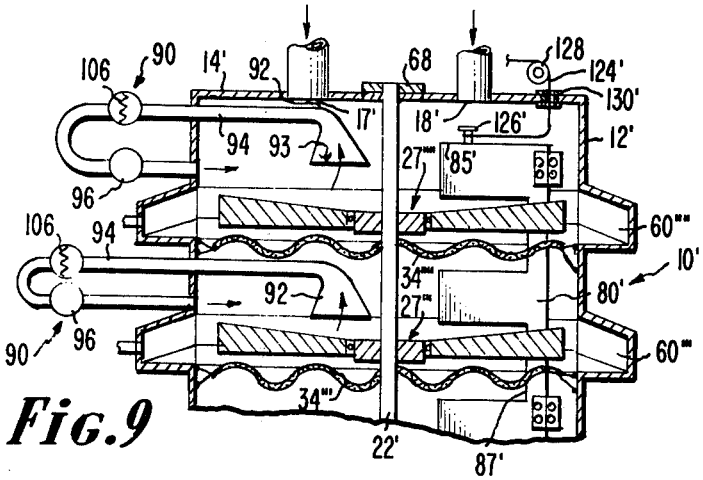
FIG. 9 is a fragmentary sectional elevational view similar to FIG. 6 illustrating a modified arrangement for removal of debris.

In a multistage embodiment incorporating baffle plates 80′ (FIG. 9) each stage may incorporate a collector assembly 90 comprised of a funnel-shaped collector 92, located slightly off-center of the axis of container 10′ with its inlet 93 facing the impeller and a duct 94 passing through side wall 12′ which leads from the narrow throat of the funnel to a coarse filter screen 106, e.g., 40 mesh. Through the duct 94 a mixture containing relatively low-density inert debris flows from the container, passes through the coarse filter 106 to separate the inert debris and returns to the operational stage from which it was withdrawn. A plurality of booster pumps 96, one associated with each stage, returns the filtered mixture to the container 10′. Generally, the funnel collector assembly 90 is incorporated only in the input or input and second stages of a multistage apparatus and the booster pumps 96 operate only when baffle plates 80′ are retracted and a high rate of rotation exists in the mixture as described above. In the multistage embodiment (FIG. 9) the baffle plates 80′ are fabricated with a plurality of notches 87′ to provide clearance at each stage for impeller assembly 27′ to 27′′′′ and associated filter 34′ to 34′′′′. Three such baffle plates are effective in operation but to prevent confusion of the drawing parts of other than the one baffle plate 80′ are omitted from FIG. 9.

Dependent on the composition of the inputted scrap and waste materials continuous operation of the defibering apparatus of this invention requires performance in the clean-out mode, with baffles 80 retracted, up to approximately 10% of the operating time and at approximately 10-minute intervals.

Figure 11:
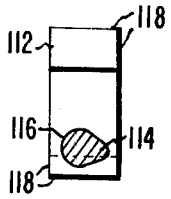
FIG. 11 is a sectional view taken along the line 11—11 of FIG. 10.
Figure 10:
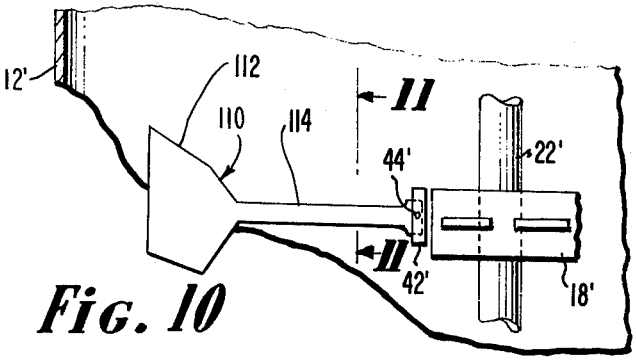
FIG. 10 is a fragmentary sectional elevational view similar to that of FIG. 4 and illustrating a modified form of impeller.

In another embodiment (FIGS. 10 and 11) the impeller blades 110 may be fabricated to provide a paddle element 112 integral with an extended generally streamlined stem 114. The streamlined contours 116 (FIG. 11) of the stem 114 reduce resistance to its passage through the mixture thereby reducing power input requirements. At the same time the high linear velocities and the blunt surfaces 118 of the paddle portion 112 which efficiently product high energy pressure waves in the mixture are maintained. The impeller energy is more efficiently applied to the paddle portion 112, which has the high linear speed and is generating the pressure waves. Operation is satisfactory with impellers having stems 114 approximating 75% of the total impeller length.

Additionally, because natural gravitational force is not a parameter having substantial effect on performance the apparatus of this invention may be operated effectively with the longitudinal axis of the container 10 oriented in the horizontal and, as circumstances may indicate, inclined at any angle from horizontal to vertical. Methods to provide ducting to inlet openings or to slightly relocate inlet openings in a non-vertical apparatus to permit inputting of scrap waste and liquid to the container without spillage will be apparent to one versed in the art and following the teaching of this invention wherein materials are inputted to the container at a location remote from the outlet opening. Also, the container 10 need not be cylindrical as illustrated in the drawings provided herein; other shapes including a square configuration are effective in the efficient performance of the defibering process. Further, the rotating axis of the shaft 22 and its associated impellers may be eccentric in relation to the longitudinal axis of the container 10; off-center positioning of the impellers is also effective in providing efficient defibering action.

Figure 6:
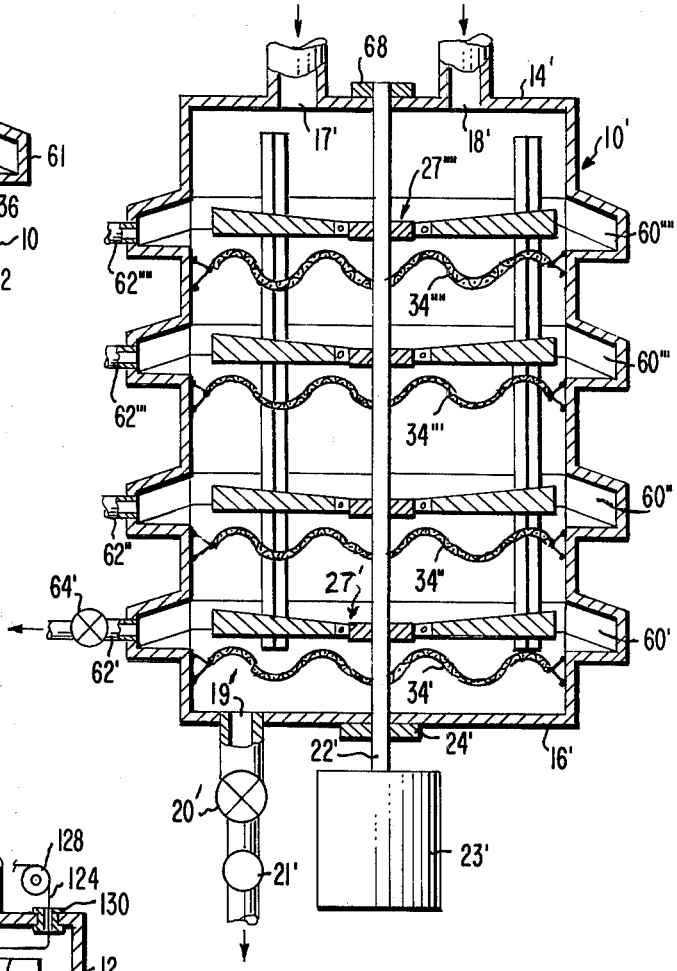
FIG. 6 is a sectional elevational view of another embodiment of this invention illustrating a multistage pulper.

In addition to using movable diaphragm filters to isolate the stages of a multistage pulper apparatus such as shown in FIG. 6, such filters may also be used to isolate the inlet portion of the pulper and the inputted material from the impeller as well as the outlet portion. Thus, in FIG. 5 another filter 34 may be provided downstream of the impeller in the manner shown in FIG. 1 or 7.

Various other modifications and uses of this invention may be made and will be apparent from the foregoing description which is presented by way of illustration of and not as a limitation on the scope of this invention. For example, in alternative embodiments of this invention a rigid filter, flexibly attached or a flexible filter, rigidly attached to the container walls may be used in place of the flexible filter 34, flexibly attached as described above. The self-cleaning features of a moving filter are retained but with a varying degree of effectiveness.

Additionally, the apparatus of this invention may in some instances be used with an inputted mixture of waste and untreated water. But to process other waste materials, or to incorporate the apparatus into a waste processing system, inputs of chemicals, chemical mixtures or solutions may replace or supplement the supply of water, and input temperatures above or below supply temperature may also be used. Use of chemicals and selected temperature conditions in the waste defibering process will combine the known advantages and disadvantages of those methods with the advantages of the apparatus and method of this invention, namely, fast, efficient, defiberization of waste with little mechanically-produced damage to fibers. Additional advantages are separation of the pulp product from inert debris, and extended operation without maintenance resulting from the self-cleaning features operative in the apparatus.

What is claimed is:

1. In a pulper apparatus for defibering cellulosic material in a liquid mixture comprising in combination:

a container, inlet and outlet openings in the container for respectively introducing liquid and scrap waste to be processed and to permit discharge of cellulosic fibers;

means for generating pressure waves in said container;

and a movable diaphragm filter in the container restricting access of inputted material to said outlet opening and allowing passage therethrough of fibered pulp:

said filter being movable in response to pressure waves produced by said generating means for removal of obstructing cellulosic materials therefrom.

2. Pulper apparatus as recited in claim 1 wherein said filter is flexible and oscillates with said pressure waves.

3. Pulper apparatus as recited in claim 1 wherein said filter is flexibly mounted.

4. Pulper apparatus as recited in claim 1 wherein said filter is positioned between said pressure-wave-generating means and said outlet opening.

5. Pulper apparatus as recited in claim 1 wherein said filter is positioned between said pressure-wave-generating means and said inlet opening whereby unfibered cellulosic material and non-cellulosic materials are restricted from contact with said pressure-wave-generating means.

6. Pulper apparatus as recited in claim 1 wherein said pressure-wave-generating means includes an impeller rotatable within the container and means for rotating said impeller.

7. Pulper apparatus as recited in claim 4 wherein said generating means includes a plurality of separate pressure-wave generators, and further comprising another of said movable filters, said filters have different sizes of passages therethrough, and one of said filters being positioned between each of said pressure-wave generators.

8. Pulper apparatus as recited in claim 1 wherein the intensity of output from said pressure-wave-generating means induces cavitational activity in said liquid mixture.

9. In an apparatus for defibering cellulosic material in a mixture of cellulosic scrap and a liquid comprising in combination: a container, an impeller assembly including impellers attached to a shaft within said container, and inlet and outlet openings in the container for respectively introducing liquid and scrap waste to be processed and to permit discharge of cellulosic fibers, the improvement of:

said impeller assembly comprising a rotor hub, a plurality of elongated impeller blades individually and hingedly attached at one end to said rotor hub, said hub being rigidly and concentrically fastened to a rotating shaft and the hinged axes of said impeller blades being generally transverse to the rotating axis of said shaft, so that centrifugal forces extend said blades radially from said rotor hub during periods of shaft rotation at operational speeds.

10. Defibering apparatus as recited in claim 9 and further comprising means for rotating said impeller shaft at a speed sufficient to generate cavitational activity in said waste mixture.

11. A pulp defibering apparatus as recited in claim 6 and further comprising means for removing debris from said mixture, said debris-removing means being operative with swirling action of said liquid mixture produced by said rotatable impeller.

12. A pulp defibering apparatus as recited in claim 11 wherein said debris-removing means comprises: a chamber circumscribing said container and attached externally thereto and upstream of said filter, and open passage means between said chamber and said container interior wherethrough debris in said mixture moves from the container interior into said chamber by the action of centrifugal forces and is segregated from said mixture, and means to withdraw said debris from said chamber.

13. A defibering apparatus as recited in claim 11 wherein said debris-removing means is located upstream of said filter and generally proximate with axis of rotation of said impeller for receiving debris in said mixture moved by the action of centripetal forces.

14. The apparatus as recited in claim 13 wherein said means to remove debris is duct means conducting said debris from said container.

15. The apparatus as recited in claim 14 further comprising means to separate said debris from accompanying cellulosic materials passing concurrently through said duct means, and propulsion means and further duct means to return said accompanying cellulosic materials to said container interior.

16. A pulp defibering apparatus as recited in claim 6 further comprising baffles within said mixture to reduce swirl in said mixture whereby the efficiency of the defibering process is enhanced.

17. A pulp defibering apparatus as recited in claim 16 wherein said baffles are movable and include means for retracting said baffles so that swirl in said mixture is unimpeded, and for extending said baffles into said mixture so that swirl in said mixture is reduced.

18. A pulp defibering apparatus as recited in claim 1 further comprising an additional outlet, said additional outlet located upstream of said filter and flow control valving affixed to both of said outlets whereby a proportionate division of flow and amount of flow of material through said outlets is controlled by the relative positioning of said control valves.

19. A process of defibering cellulosic material in medium comprising a mixture of a liquid and said cellulosic materials to be defibered, said process comprising the steps of:

impelling a liquid so as to propagate pressure waves through a moveable diaphragm membrane in contact with said liquid to said medium on the other side of said diaphragm so that said cellulosic material is defibered by said pressure waves.

20. The process of claim 19 and further comprising the step of withdrawing said defibered material through a filter from said medium.

21. The process of claim 19 wherein said diaphragm membrane includes means for filtering fibers of a certain diameter, and wherein said process further comprises the step of withdrawing through said filtering means said defibering material from said medium.

22. The process of claim 19 wherein said cellulosic material is in the form of urban waste and includes non-cellulosic debris, and said process further includes the step of removing said debris from said medium upstream of said filtering means.

23. The process of claim 19 wherein the pressure waves propagated by said impelling produce cavitational activity in said medium.

24. The process as recited in claim 19 wherein said cellulosic material is in the form of urban waste and includes non-cellulosic debris, and said process includes removing debris from said medium upstream of said filtering means by applying rotational forces to said medium.

25. The process as recited in claim 24 wherein the applied rotational forces are centrifugal.

26. The process as recited in claim 24 wherein the applied rotational forces are centripetal.

27. A process of defibering cellulosic material in a medium comprising:

impelling a liquid in a plurality of stages to defiber cellulosic material in each of said stages;

and passing and filtering defibered material from a first one of said stages to the next thereof.

28. The defibering process of claim 27 and further comprising passing and filtering defibered material to an outlet.

29. The defibering process of claim 28 wherein said progressive filtering stages from the first one of said stages to said outlet reject from passage progressively smaller sizes of material.

30. The defibering process of claim 29 and further comprising passing to another outlet defibered material from one of said stages whereby defibered material of different sizes is obtained at said outlets.

31. The defibering process of claim 27 and further comprising continuously supplying cellulosic material to be defibered to a first one of said stages, and continuously withdrawing defibered material from a last one of said stages, and wherein said impelling is performed continuously.

* * * * *